US005649427A

United States Patent [19]

Sawada et al.

[11] Patent Number: 5,649,427

[45] Date of Patent: Jul. 22, 1997

[54] WHITE SMOKE GENERATING APPARATUS AND METHOD OF USING THE SAME

[75] Inventors: Hiroyuki Sawada; Hisayuki Usui; Ryutaro Takahashi; Masahiro Hirano; Masahiro Yonekura, all of Kawasaki, Japan

[73] Assignee: Nippon Sanso Corporation, Tokyo, Japan

[21] Appl. No.: 597,909

[22] Filed: Feb. 7, 1996

[30] Foreign Application Priority Data

Feb. 13, 1995 [JP] Japan ..... 7-024432

[51] Int. Cl.[6] ..... F17C 7/02

[52] U.S. Cl. ..... 62/50.2; 62/48.1

[58] Field of Search ..... 62/45.1, 50.1, 62/52.1, 50.2

[56] References Cited

U.S. PATENT DOCUMENTS

| | | | |
|---|---|---|---|
| 4,771,608 | 9/1988 | Liu et al. | 62/48.1 |
| 4,829,773 | 5/1989 | Matsumura et al. | 62/50.1 |
| 5,331,822 | 7/1994 | Belliveau et al. | 62/168 |

*Primary Examiner*—Henry A. Bennett
*Assistant Examiner*—Pamela A. O'Connor
*Attorney, Agent, or Firm*—Dilworth & Barrese

[57] ABSTRACT

The present invention provides a white smoke generating apparatus for generating white smoke of a stable density unaffected by air temperature or humidity conditions. The apparatus comprises an apparatus main body 11 being provided with a white smoke discharge opening 11*a*; a cryogenic liquefied gas supply mechanism 12 for supplying a cryogenic liquefied gas into the apparatus main body 11; and a humidifying mechanism 13 for humidifying the atmosphere inside the apparatus main body. The cryogenic liquefied gas supply mechanism 12 is provided with a first pipeline 18 which communicates a cryogenic liquefied gas reservoir 16 and a cryogenic liquefied gas emission nozzle 17 placed inside the apparatus main body 11, preferably at the white smoke discharge opening 11*a* side. The humidifying mechanism 13 comprises a second pipeline 24 which branches from the first pipeline 18 and communicates with a spray nozzle 21 placed inside the apparatus main body 11 for spraying water, and a third pipeline 28 which branches from the second pipeline 24 and communicates with the spray nozzle 21 via a water reservoir 25. A cryogenic liquefied gas vaporizer 22 is provided inside the second pipeline 24 upstream from the point where the third pipeline 28 branches from the second pipeline 24.

13 Claims, 4 Drawing Sheets

WHITE SMOKE GENERATING APPARATUS AND METHOD OF USING THE SAME

BACKGROUND OF THE INVENTION

1. Field of the Invention

The present invention relates to a white smoke generating apparatus and to a method of using the same, wherein white smoke is generated by sending a gas and a supply of water to a spray nozzle placed inside an apparatus main body of a white smoke generating apparatus which is provided with a white smoke discharge opening, spraying the water to create a humid atmosphere within the apparatus, emitting a cryogenic liquefied gas inside the apparatus, and then discharging the white smoke generated thereby through the white smoke discharge opening.

2. Description of the Related Art

Conventionally known white smoke generating apparatuses for use in enhancing stage effects of various shows and events include the following. Namely, there is an apparatus in which a cryogenic liquefied gas, such as liquid nitrogen, liquid air, or liquid carbon dioxide, is emitted from a pipe or any type of nozzle which provides a widely diffusing spray. The water vapor in the air condenses as it comes in contact with the cold gas, generating white smoke. Further, an apparatus is also known wherein a cone having a plurality of holes is placed around the aforementioned pipe or nozzle to take in air, with the water vapor condensing as it comes in contact with the cold gas. Accordingly, with this apparatus, conditions can be adjusted to facilitate the generation of white smoke.

An explanation will now be made with reference to FIG. 4 of a conventional white smoke generating apparatus and method in which liquid nitrogen is employed as the cryogenic liquefied gas.

The white smoke generating apparatus 1 shown in FIG. 4 is composed primarily of a thermally insulated pressure vessel 3 which contains cryogenic liquid nitrogen 2 contained inside; a nozzle 4 for emitting the cryogenic liquid nitrogen 2; a cryogenic liquid nitrogen flow control valve 6 interposed along a pipeline 5 which communicates the thermally insulated pressure vessel 3 and the nozzle 4; and a cone 7 which has a plurality of holes 7*a* and is placed about the nozzle 4.

In order to generate white smoke 8 using the above-described apparatus 1, the cryogenic liquid nitrogen flow control value 6 is opened, supplying the cryogenic liquid nitrogen 2 to the nozzle 4 via the pipeline 5. The cryogenic liquid nitrogen 2 is then emitted outwardly from the cone 7. Air is pulled into the cone 7 via the plurality of holes 7*a*, with the water vapor in the air condensing as it comes in contact with the liquid nitrogen 2 to generate white smoke 8, which is then discharged into the air from the cone 7.

In order to stop generation of the white smoke, the cryogenic liquid nitrogen flow control value 6 is closed to terminate the supply of the cryogenic liquid nitrogen 2 to the nozzle 4.

However, the above-described white smoke generating apparatus and method whereby white smoke is generated by emitting the cryogenic liquid nitrogen 2 from the nozzle 4 to condense water vapor in the air is disadvantageous for the following reason. That is, air temperature and humidity conditions cause variations to occur in the density of the white smoke produced. Accordingly, performance effects will differ greatly depending on the season and weather conditions, making it difficult to obtain the desired effects.

SUMMARY OF THE INVENTION

The present invention was conceived in consideration of the aforementioned problem, and has as its objective the provision of a white smoke generating apparatus and method which enables the generation of white smoke of a stable density unaffected by air temperature or humidity conditions.

In a first aspect of the present invention, there is provided a white smoke generating apparatus comprising: an apparatus main body being provided with a white smoke discharge opening, the apparatus main body containing an atmosphere therein; a cryogenic liquefied gas supply mechanism for supplying a cryogenic liquefied gas into the apparatus main body; and a humidifying mechanism for humidifying the atmosphere inside the apparatus main body; wherein the cryogenic liquefied gas supply mechanism is provided with a first pipeline which communicates a cryogenic liquefied gas reservoir and a cryogenic liquefied gas emission nozzle placed inside the apparatus main body, preferably at the white smoke discharge opening side; the humidifying mechanism comprises a second pipeline which branches from the first pipeline and communicates with a spray nozzle placed inside the apparatus main body for spraying water, and a third pipeline which branches from the second pipeline and communicates with the spray nozzle via a water reservoir; and a cryogenic liquefied gas vaporizer is provided inside the second pipeline upstream from the point where the third pipeline branches from the second pipeline.

It is also possible for the humidifying mechanism in this first aspect of the present invention to be a mechanism which serves to both humidify and heat the atmosphere inside the apparatus main body.

In a second aspect of the present invention, there is provided a white smoke generating apparatus comprising: an apparatus main body being provided with a white smoke discharge opening, the apparatus main body containing an atmosphere therein; a cryogenic liquefied gas supply mechanism for supplying a cryogenic liquefied gas into the apparatus main body; and a humidifying mechanism for humidifying the atmosphere inside the apparatus main body; wherein the cryogenic liquefied gas supply mechanism is provided with a first pipeline which communicates a cryogenic liquefied gas reservoir and a cryogenic liquefied gas emission nozzle placed inside the apparatus main body, preferably at the white smoke discharge opening side; the humidifying mechanism is provided with a second pipeline which communicates an air compressor for supplying air and a spray nozzle placed inside the apparatus main body for spraying water, and a third pipeline which branches from the second pipeline and communicates with the spray nozzle via a water reservoir.

In this second aspect of the present invention, the humidifying mechanism may be a mechanism for humidifying and heating the atmosphere inside the apparatus main body, the mechanism being provided with a fourth pipeline for directing a portion of the air from the air compressor into the apparatus main body via a heating means.

In a third aspect of the present invention, there is provided an apparatus characterized in that, in a white smoke generating apparatus according to one of either the first or second aspects of the present invention, an air intake opening is provided to the apparatus main body.

In a fourth aspect of the present invention, there is provided an apparatus characterized in that, in a white smoke generating apparatus according to the third aspect of the present invention, an air supply mechanism for sending air into the apparatus main body and a heating means for heating the air are provided at the air intake opening.

In a fifth aspect of the present invention, there is provided an apparatus characterized in that, in a white smoke generating apparatus according to one of the first through fourth aspects of the present invention, two or more white smoke discharge openings are provided to the apparatus main body.

In a sixth aspect of the present invention, there is provided a white smoke generating method comprising the steps of: spraying water by sending gas along with a supply of water to a spray nozzle placed inside an apparatus main body being provided with a white smoke discharge opening so as to create a humid atmosphere inside the apparatus main body; generating white smoke by emitting cryogenic liquefied gas into the humid atmosphere inside the apparatus main body; and discharging the white smoke through the white smoke discharge opening.

In a seventh aspect of the present invention, there is provided a method characterized by, in addition to the white smoke generating method according to the sixth aspect of the present invention, comprising the step of supplying air into the apparatus main body.

In an eighth aspect of the present invention, there is provided a method characterized by, in addition to the white smoke generating method according to the seventh aspect of the present invention, comprising the step of heating the air when the air is supplied into the apparatus main body, while the amount of the air supplied is regulated.

The present invention functions as follows.

In the white smoke generating apparatuses of the first through fifth aspects of the present invention, a cryogenic liquefied gas emission nozzle and a spray nozzle for spraying water are provided inside an apparatus main body, enabling the atmosphere inside the apparatus main body to be humidified by spraying water from the spray nozzle. Thus, the conditions of the atmosphere inside the apparatus main body necessary to generate white smoke of the desired density and amount can be appropriately controlled. As a result, by then emitting a cryogenic liquefied gas from the cryogenic liquefied gas emission nozzle into the atmosphere inside the apparatus main body, white smoke of a stable density, unaffected by ambient air temperature or humidity conditions, can be generated.

Further, in the white smoke generating apparatus according to the first aspect of the present invention, the humidifying mechanism comprises a second pipeline which branches from the first pipeline and communicates with a spray nozzle placed inside the apparatus main body for spraying water, and a third pipeline which branches from the second pipeline and communicates with the spray nozzle via a water reservoir. In addition, a cryogenic liquefied gas vaporizer is provided inside the second pipeline upstream from the point at which the third pipeline branches from the second pipeline. As a result of this design, gas supplied from the cryogenic liquefied gas reservoir which has been vaporized by the cryogenic liquefied gas vaporizer can be employed to increase the pressure inside the water reservoir, which is necessary in order to make the size of the water droplets sprayed from the spray nozzle small. Accordingly, it is not necessary to add another source for increasing the pressure inside the water reservoir. Further, because gas to be emitted can be directly supplied to the spray nozzle via the second pipeline, it is possible to regulate the condition of the spray to make the size of the water droplets extremely small.

Further, in the white smoke generating apparatus according to the second aspect of the present invention, the humidifying mechanism comprises a second pipeline which communicates an air compressor for supplying air and a spray nozzle placed inside an apparatus main body for spraying water, and a third pipeline which branches from the second pipeline and communicates with the spray nozzle via a water reservoir. As a result of this design, air supplied from the air compressor can be employed to increase the pressure inside the water reservoir in order to supply the water which will be sprayed from the spray nozzle. Further, the air from the air compressor is supplied to the spray nozzle via the second pipeline, and the size of the water droplets sprayed from the spray nozzle can be adjusted to be very small.

In the white smoke generating apparatus according to the third aspect of the present invention, an air intake opening is provided to the apparatus main body. A cryogenic liquefied gas is emitted from the cryogenic liquefied gas emission nozzle, causing an ejector effect which facilitates the flow of air from the air intake opening toward the white smoke discharge opening.

Further, in the white smoke generating apparatus according to the fourth aspect of the present invention, an air supply mechanism and a heating means are provided to the air intake opening. Accordingly, the amount of air sent into the apparatus main body can be controlled. Thus, the amount and density of the white smoke generated when cryogenic liquefied gas supplied into the apparatus main body comes in contact with the air can also be controlled.

In the white smoke generating apparatus according to the fifth aspect of the present invention, two or more white smoke discharge openings are provided to the apparatus main body, making it possible to discharge white smoke with the desired number of streams in the desired directions.

In the white smoke generating method according to the sixth aspect of the present invention, gas is sent along with a supply of water to a spray nozzle placed in an apparatus main body being provided with a white smoke discharge opening. The water is sprayed inside the apparatus main body to create a humid atmosphere. By emitting a cryogenic liquefied gas into the humid inner atmosphere of the apparatus main body, it is possible to generate white smoke of a stable density, unaffected by ambient air temperature or humidity conditions.

In the white smoke generating methods according to the seventh and eighth aspects of the present invention, air is sent separately into the apparatus main body or, alternatively, the amount and heating temperature of the air is controlled, in the white smoke generating method according to the sixth aspect of the present invention. As a result, the amount and density of the white smoke generated when the air sent into the apparatus main body and the cryogenic liquefied gas supplied into the apparatus main body come in contact can be controlled with ease.

The effects of the present invention will now be explained.

As explained above, in the white smoke generating apparatuses according to the first through fifth aspects of the present invention, a cryogenic liquefied gas emission nozzle and a spray nozzle for spraying water are placed inside an apparatus main body. As a result, the atmosphere inside the apparatus main body can be humidified by spraying water from the spray nozzle, permitting conditions of the atmosphere inside the apparatus main body to be appropriately controlled so as to generate white smoke of a desired density and amount. Thus, by emitting this atmosphere inside the apparatus main body with a cryogenic liquefied gas from the cryogenic liquefied gas emission nozzle, it is possible to generate white smoke of a stable density, unaffected by ambient air temperature and humidity conditions. Accordingly, the desired performance effects can be achieved. Further, in this white smoke generating apparatus, the cryogenic liquefied gas emission nozzle and the spray nozzle are provided inside the apparatus main body, while a cryogenic liquefied gas supply mechanism and humidifying mechanism are provided to the outside of the apparatus. Accordingly, the apparatus can be simplified, facilitating its manufacture.

In the white smoke generating apparatus according to the first aspect of the present invention, the humidifying mechanism comprises a second pipeline which branches from the first pipeline and communicates with a spray nozzle placed inside the apparatus main body for spraying water, and a third pipeline which branches from the second pipeline and communicates with the spray nozzle via a water reservoir. In addition, a cryogenic liquefied gas vaporizer is provided inside the second pipeline upstream from the point at which the third pipeline branches from the second pipeline. As a result of this design, cryogenic liquefied gas supplied from the cryogenic liquefied gas reservoir that has been vaporized by the cryogenic liquefied gas vaporizer can be employed to increase the pressure inside the water reservoir, which is necessary in order to make the size of the water droplets sprayed from the nozzle small. Accordingly, since it is not necessary to add another source for increasing the pressure inside the water reservoir, the apparatus can be made more compact, thus requiring less space. Further, because gas to be emitted can be directly supplied to the spray nozzle via the second pipeline, it is possible to regulate the condition of the spray to make the size of the water droplets extremely small, enabling white smoke having the desired characteristics to be obtained.

Moreover, in the white smoke generating apparatus according to the first aspect of the present invention, in the case where the humidifying mechanism is one which both humidifies and heats the atmosphere inside the apparatus main body, the white smoke generating apparatus is provided with a cryogenic liquefied gas emission nozzle and a spray nozzle inside the apparatus main body, and with a cryogenic liquefied gas supply mechanism and a humidifying and heating mechanism outside the apparatus main body. Accordingly, the apparatus can be simplified, facilitating its manufacture.

In the white smoke generating apparatus according to the second aspect of the present invention, the humidifying mechanism comprises a second pipeline which communicates an air compressor for supplying air and a spray nozzle placed inside the apparatus main body for spraying water, and a third pipeline which branches from the second pipeline and communicates with the spray nozzle via a water reservoir. As a result, air supplied from the air compressor can be effectively employed to increase the pressure inside the water reservoir in order to make the size of the water droplets sprayed from the spray nozzle small. Further, because this air can be supplied to the water spray nozzle via the second pipeline, the condition of the spray can be regulated to make the size of the water droplets sprayed from the spray nozzle extremely small, thus enabling white smoke having the desired characteristics to be obtained.

In the white smoke generating apparatus according to the second aspect of the present invention, the humidifying mechanism is additionally provided with a fourth pipeline to direct a portion of the air from the air compressor into the apparatus main body via a heating means. In the case where the humidifying mechanism is a humidifying and heating mechanism for both humidifying and heating the atmosphere inside the apparatus main body, the white smoke generating apparatus is provided with a cryogenic liquefied gas emission nozzle and a spray nozzle inside the apparatus main body, and with a cryogenic liquefied gas supply mechanism and a humidifying and heating mechanism outside the apparatus main body. As a result, the apparatus can be further simplified, facilitating its manufacture.

Further, in the white smoke generating apparatus according to the third aspect of the present invention, an air intake opening is provided to the apparatus main body, and the cryogenic liquefied gas is emitted from the cryogenic liquefied gas emission nozzle to generate an ejector effect. Accordingly, air flows easily from the air intake opening toward the white smoke discharge opening, a feature which is advantageous to increasing the amount of white smoke generated.

In the white smoke generating apparatus according to the fourth aspect of the present invention, an air supply mechanism and a heating means are provided to the air intake opening, permitting control of the amount and temperature of the air sent into the apparatus main body. Thus, it is also possible to control the amount and density of the white smoke generated when this air comes in contact with the cryogenic liquefied gas supplied into the apparatus main body, permitting the desired performance effects to be obtained.

Further, in the white smoke generating apparatus according to the fifth aspect of the present invention, two or more white smoke discharge openings are provided to the apparatus main body. Thus, white smoke can be discharged with the desired number of streams in the desired directions, in order to obtain the desired performance effect.

Moreover, in the white smoke generating method according to the sixth aspect of the present invention, gas along with a supply of water is sent to a spray nozzle placed inside an apparatus main body being provided with a white smoke discharge opening, the water is sprayed inside the apparatus main body to create a humid atmosphere therein, a cryogenic liquefied gas is emitted into the humid inner atmosphere of the apparatus main body to generate white smoke, and the white smoke is discharged from the white smoke discharge opening. As a result, the conditions of the atmosphere inside the apparatus main body necessary to generate white smoke of a desired density can be appropriately controlled. By emitting the atmosphere inside the apparatus main body with cryogenic liquefied gas from the cryogenic liquefied gas emission nozzle, it is possible to generate white smoke of a stable density, unaffected by ambient air temperature and humidity conditions. Accordingly, the desired performance effects can be achieved.

Moreover, in the white smoke generating methods according to the seventh and eighth aspects of the present invention, the air is sent separately into the apparatus main body, or alternatively, the amount and heating temperature of the air sent into the apparatus main body is controlled. Thus, the amount and density of the white smoke generated when the air sent into the apparatus main body and the cryogenic liquefied gas supplied to the apparatus main body come in contact can be controlled with ease to obtain the desired performance effects.

DESCRIPTION OF THE PREFERRED EMBODIMENTS

Figure 1:
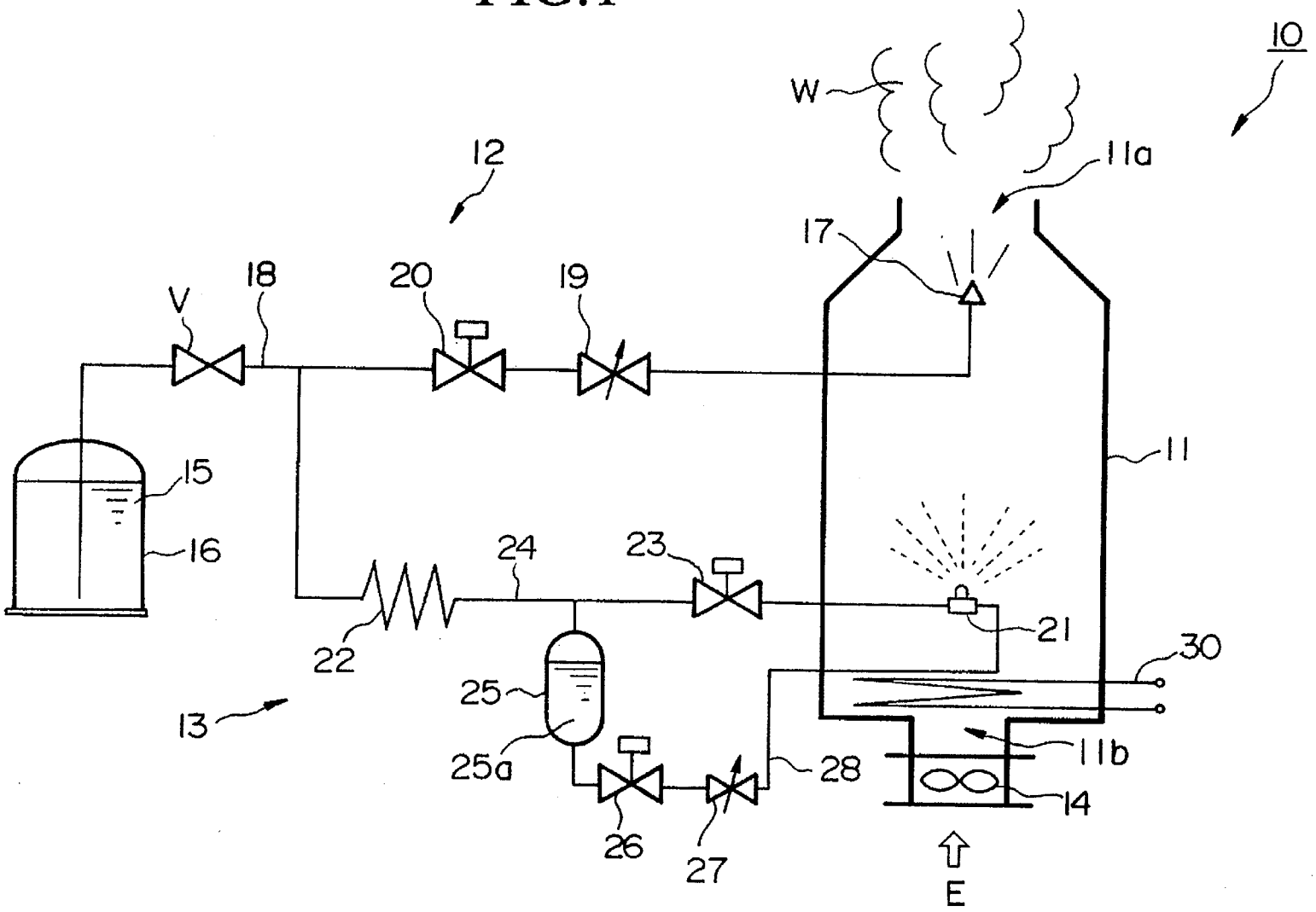
FIG. 1 is a schematic structural diagram showing a first embodiment of the white smoke generating apparatus of the present invention.

FIG. 1 is a diagram showing a first embodiment of the white smoke generating apparatus of the present invention. Reference numeral 10 in this figure indicates the white smoke generating apparatus itself. White smoke generating apparatus 10 is mainly composed of an apparatus main body 11, a cryogenic liquefied gas supply mechanism 12, and a humidifying mechanism 13.

The apparatus main body 11 is a bottle-shaped vessel for generating white smoke W by directly bringing into contact and mixing air E, which has been heated and humidified inside the apparatus main body, and a cryogenic liquefied gas. This vessel has a white smoke discharge opening 11*a* provided to the upper portion thereof for discharging white smoke W to the outside.

Further, it is preferable to provide an air intake opening 11*b* to the bottom of the apparatus main body 11. By emitting a cryogenic liquefied gas 15 from a cryogenic liquefied gas emission nozzle 17 as will be explained below, an ejector effect is generated. When this occurs, air or the like easily flows from the air intake opening 11*b* toward the white smoke discharge opening 11*a*, making this feature advantageous in increasing the amount of white smoke W generated.

The cryogenic liquefied gas emission nozzle 17 to be explained below is placed inside the apparatus main body 11 at the white smoke discharge opening 11*a* side, while a spray nozzle 21, also explained below, for spraying water is provided inside the apparatus main body 11 at the air intake opening 11*b* side.

Further, it is preferable to provide an air supply mechanism 14 to the air intake opening 11*b* for sending air E inside the apparatus main body 11. In this case, a fan or blower may be suitably employed as this air supply mechanism 14. When an air supply mechanism 14 is provided to the air intake opening 11*b*, the amount of air being sent into the apparatus main body 11 can be freely controlled by changing the number of rotations of the rotor, fan vanes or the like.

The cryogenic liquefied gas supply mechanism 12 supplies the cryogenic liquefied gas 15 into the apparatus main body 11. It is provided with a first pipeline 18 which communicates a cryogenic liquefied gas reservoir 16 where the cryogenic liquefied gas 15 is stored and the cryogenic liquefied gas emission nozzle 17 for emitting the cryogenic liquefied gas 15 into the apparatus main body 11, via a first solenoid valve 20 and a cryogenic liquefied gas flow control valve 19. The first solenoid valve 20 carries out the generation or cessation of white smoke. Further, the symbol V in the figure indicates a main valve of the cryogenic liquefied gas reservoir 16. Liquid nitrogen, liquid carbon monoxide, liquid argon, liquid air or the like may be employed as the cryogenic liquefied gas 15.

The humidifying mechanism 13 humidifies air E sent into the apparatus main body 11 via the air intake opening 11*b*. It is composed of a second pipeline 24, which branches from the first pipeline 18 upstream from the solenoid valve 20 and communicates via a cryogenic liquefied gas vaporizer 22 and a second solenoid valve 23 with the spray nozzle 21 placed inside the apparatus main body 11 for spraying water with or without gas; and a third pipeline 28, which branches from the second pipeline 24 upstream from the second solenoid valve 23 and communicates with the spray nozzle 21 via a water reservoir 25 which holds water 25*a*, a third solenoid valve 26, and a flow control valve 27.

By opening or closing the second solenoid valve 23 the supply of gas to the spray nozzle 21 can be initiated or terminated. The third solenoid valve 26 is employed to start or stop the supply of water to the spray nozzle 21 from the water reservoir 25. The flow control valve 27 regulates the supply of water to the spray nozzle 21.

Next, the method of generating white smoke W employing the above-described apparatus 10 will be explained.

First, the main valve V is opened and the cryogenic liquefied gas 15 from the cryogenic liquefied gas reservoir 16 enters into the second pipeline 24 from the first pipeline 18. The cryogenic liquefied gas 15 is then vaporized by the cryogenic liquefied gas vaporizer 22. The vaporized gas is then supplied to the spray nozzle 21 via the second solenoid valve 23 on the second pipeline 24, while the third solenoid valve 26 is opened to introduce the vaporized gas into the water reservoir 25. The pressure inside the water reservoir 25 increases as the gas enters the reservoir, supplying water 25*a* to the spray nozzle 21 via the third pipeline 28. The amount of water supplied in this case is controlled by the water flow control valve 27. Next, water 25*a* from the spray nozzle 21 is sprayed inside the apparatus main body 11 alone or along with gas, humidifying the air E inside the apparatus main body. The amount of the air sent to the apparatus main body 11 is controlled by the air supply mechanism 14 provided to the air intake opening 11*b*. The amount of humidification is preferably a saturated moisture level at 30° C. to 80° C., and more preferably a saturated moisture level at 30° C. to 40° C. In addition, the air E is heated by a heater 30, preferably to a temperature of 30° C. to 80° C., and more preferably 30° C. to 40° C.

First the solenoid valve 20 is opened, and the cryogenic liquefied gas 15 is introduced into the first pipeline 18 from the cryogenic liquefied gas reservoir 16, and is supplied to the cryogenic liquefied gas spray nozzle 17 via the flow control valve 19. As a result, the cryogenic liquefied gas 15 is emitted inside the apparatus main body 11 from the cryogenic liquefied gas emission nozzle 17. The emitted cryogenic liquefied gas 15 comes in contact and mixes with air E which has been humidified inside the apparatus main body 11. The amount of cryogenic liquefied gas 15 supplied to the cryogenic liquefied gas emission nozzle 17 is controlled by the cryogenic liquefied gas flow control valve 19. The thus humidified and heated air E and the cryogenic liquefied gas 15 come in contact and mix with each other inside the apparatus main body 11 to generate white smoke W which is then discharged from the white smoke discharge opening 11*a*. The amount of white smoke W generated in this case may be controlled using the air supply mechanism 14, the cryogenic liquefied gas flow control valve 19, the water flow control valve 27, and the second solenoid valve 23 for spraying the gas.

To stop the generation of white smoke W, the supply of the cryogenic liquefied gas 15 is stopped by closing the first solenoid valve 20, thereby preventing contact between the humidified air E and the cryogenic liquefied gas 15.

In this white smoke generating apparatus 10 and white smoke generating method, water 25*a* is sprayed with or without gas from the spray nozzle 21 to appropriately humidify air E inside the apparatus main body 11, while air E is suitably heated by the heater 30. In this way, the conditions of the air E inside the apparatus main body 11 necessary to generate white smoke of a desired density can be controlled. Thus, white smoke of a stable density, unaffected by ambient air temperature and humidity conditions, can be generated by emitting the air E with the cryogenic liquefied gas 15 from the cryogenic liquefied gas emission nozzle 17. Accordingly, desired performance effects can be obtained. Further, the cryogenic liquefied gas emission nozzle 17, the spray nozzle 21, and the heater 30 for heating the air are placed inside the apparatus main body 11 of this white smoke generating apparatus 10, while the cryogenic liquefied gas supply mechanism 12 and the humidifying mechanism 13 are provided outside the apparatus 10, thereby simplifying the apparatus and facilitating its manufacture.

Further, the humidifying mechanism 13, which branches from the first pipeline 18, vaporizes the cryogenic liquefied gas by means of the cryogenic liquefied gas vaporizer 22. The vaporized gas is supplied to the spray nozzle 21 via the second pipeline 24. In addition, a portion of the vaporized gas is introduced into the water reservoir 25 which is provided along the third pipeline 28 which branches from the second pipeline 24, thus increasing the pressure on the water 25*a* stored in the water reservoir 25. Under the increased pressure, water 25*a* is thereby supplied to the spray nozzle 21 inside the apparatus main body 11. Thus, the cryogenic liquefied gas 15 is not only used as the material for generating white smoke, but is also employed to increase the pressure on the water 25*a* inside the water reservoir 25 so that water to humidify the air inside the apparatus main body 11 is supplied to the spray nozzle 21. Accordingly, it is not necessary to provide another gas for pressurization, so that the apparatus can be made more compact, requiring less space. Further, since a portion of the vaporized gas from the cryogenic liquefied gas 15 is directly supplied to the water spray nozzle 21 by the second pipeline 24, the spray condition can be adjusted so that the droplets of water sprayed from spray nozzle 21 are extremely small, permitting a very fine white smoke to be generated.

In addition, the air intake opening 11*b* is provided to one end of the apparatus main body 11, for example, at the bottom of the apparatus. By emitting the cryogenic liquefied gas 15 from the cryogenic liquefied gas emission nozzle 17, an ejector effect is generated which facilitates the flow of air or the like from the air intake opening 11*b* toward the white smoke discharge opening 11*a*, a feature which is advantageous in increasing the amount of white smoke W.

Moreover, because the air supply mechanism 14 is provided to the air intake opening 11*b*, the amount of air taken into the apparatus main body 11 can be controlled. As a result, the amount of white smoke W generated when air E comes in contact with the cryogenic liquefied gas 15 supplied into the apparatus main body 11 can be controlled. Thus, the desired performance effects can be obtained.

Figure 2:
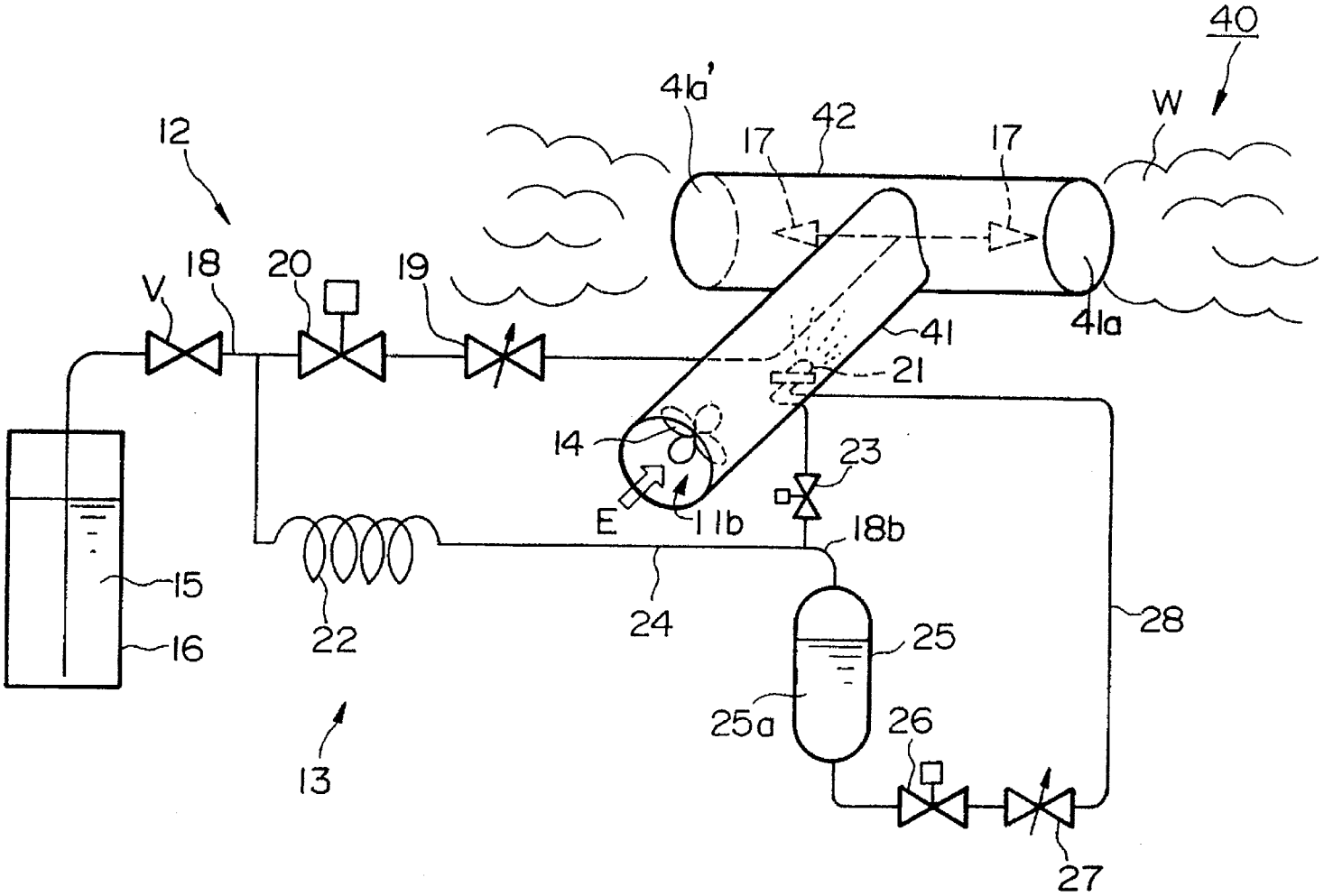
FIG. 2 is a schematic structural diagram showing a second embodiment of the white smoke generating apparatus of the present invention.

FIG. 2 shows a second preferred embodiment of the white smoke generating apparatus of the present invention, where the white smoke generating apparatus 40 differs from the white smoke generating apparatus 10 shown in FIG. 1 in that the apparatus main body 41 is cylindrical and in that two or more (two in the figure) white smoke discharge openings 41*a*,41*a'* are provided to one end of the apparatus main body 41.

In order to provide the apparatus main body 41 with two or more white smoke discharge openings 41*a*,41*a'*, the apparatus main body 41 may be connected with a duct joint 42. The duct joint 42 employed here may, for example, be a T joint, Y joint, cross joint or the like.

The method for generating white smoke W using this white smoke generating apparatus 40 employs the same pipelines and equipment as those of the method for generating white smoke W using the white smoke generating apparatus 10 shown in FIG. 1 and explained above. An explanation thereof will therefore be omitted here.

In this white smoke generating apparatus 40, since two or more white smoke discharge openings 41*a*,41*a'* are provided to the apparatus main body 41 by connecting the apparatus main body 41 with the duct joint 42, white smoke can be generated with the desired number of streams in the desired directions to obtain the desired performance effects.

Figure 3:
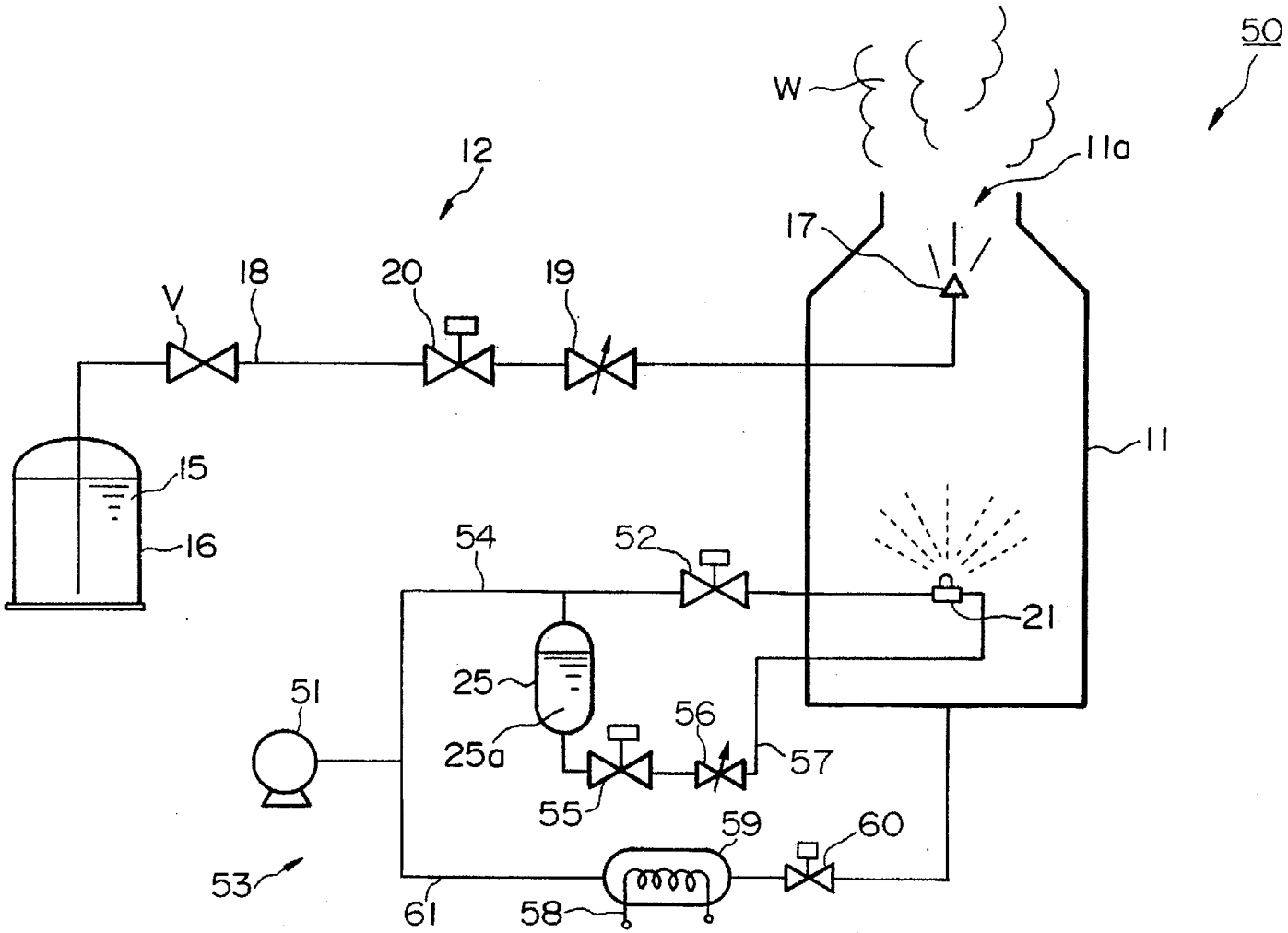
FIG. 3 is a schematic structural diagram showing a third embodiment of the white smoke generating apparatus of the present invention.
Figure 4:
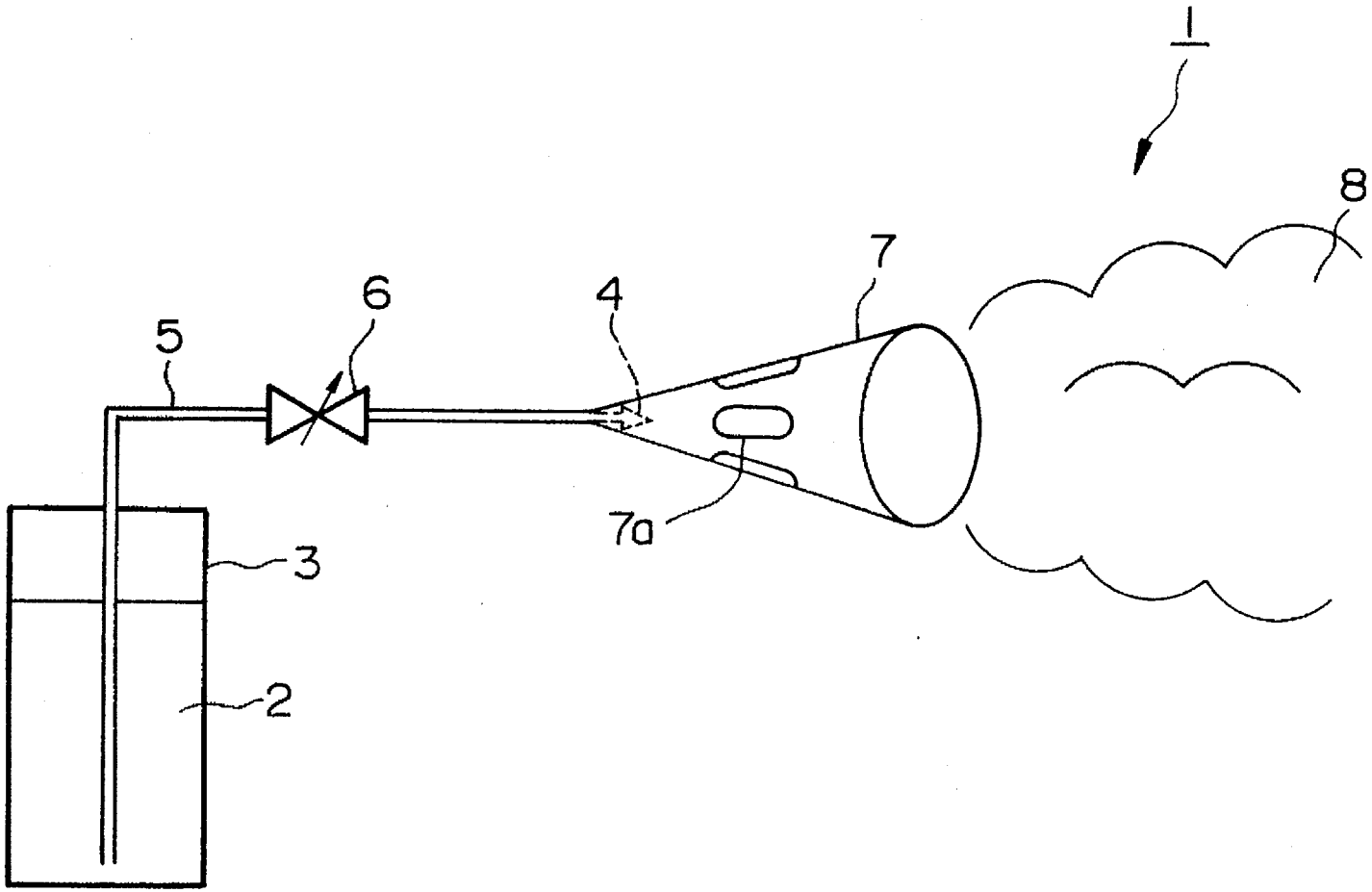
FIG. 4 is a diagram provided to explain a conventional white smoke generating apparatus and method.

FIG. 3 shows a third embodiment of the white smoke generating apparatus of the present invention. The same reference numerals and symbols have been employed where the parts of this apparatus are identical to those of the first and second embodiments shown in FIGS. 1 and 2 respectively. White smoke generating apparatus 50 shown in FIG. 3 differs from the white smoke generating apparatus 10 shown in FIG. 1 in the following way. Namely, the humidifying mechanism 13 shown in FIG. 1 is provided with a second pipeline 24 which branches from a first pipeline 18 which is connected to a cryogenic liquefied gas reservoir 16 and supplies a cryogenic liquefied gas 15 for spraying inside the apparatus main body 11, and with a third pipeline 28 which branches from the second pipe line 24. In contrast, in the white smoke generating apparatus 50 of this third embodiment, a humidifying and heating mechanism 53 is segregated from a first pipeline 18 which communicates a cryogenic liquefied gas reservoir 16 and a cryogenic liquefied gas spray nozzle 17, and thus is an independent pipeline system.

In other words, the heat and humidifying mechanism 53 is provided with an air compressor 51; a second pipeline 54 which sends air for increasing the pressure inside a water reservoir 25 from the air compressor 51 and is attached to a water spray nozzle 21 inside the apparatus main body 11 via a second solenoid valve 52; and a third pipeline 57 which branches from the second pipeline 54 upstream from the second solenoid valve 52, and supplies water to the water spray nozzle 21 via the water reservoir 25, a third solenoid valve 55, and a water control valve 56. Further, in this third embodiment of the present invention, a fourth pipeline 61 is provided which diverts a portion of the compressed air from the air compressor 51 to an air intake opening 11*b* of an air supply mechanism 14 which is provided to one end of the apparatus main body 11 via an air reservoir 59, which is provided with a heating means 58 such as a heater, and a fourth solenoid valve 60.

In the method for generating white smoke W using this white smoke generating apparatus 50, in the cryogenic liquefied gas supply mechanism 12, the cryogenic liquefied gas 15 is supplied to the cryogenic liquefied gas spray nozzle 17 inside the apparatus main body 11 from the cryogenic liquefied gas reservoir 16 via the first pipeline 18. Further, in the heating and humidifying mechanism 53 wherein a portion of the compressed air introduced into the second pipeline 54 from the air compressor 51 to be sent to the water spray nozzle 21 is diverted to the water reservoir 25 via the third pipeline 57 which branches from the second pipeline 54, increasing the pressure inside the water reservoir 25 to supply water 25*a* to the water spray nozzle 21. Moreover, the portion of the compressed air from the air compressor 51 traveling through the fourth pipeline 61 is heated via the heating means 58 inside the air reservoir 59. The air is then introduced into the air intake opening 11*b*, and supplied into the apparatus main body 11.

In the white smoke generating apparatus 50 of this third embodiment, the humidifying and heating mechanism 53 comprises the second pipeline 54 which is attached to the air compressor 51 and the water spray nozzle 21 placed in the apparatus main body 11; and the third pipeline 57 which branches from the second pipeline 54 and is connected to the water spray nozzle 21 via the water reservoir 25. In addition, the fourth pipeline 61 is provided which introduces a portion of the air from the air compressor 51 into the apparatus main body 11 via the air reservoir 59 which is provided with the heating means. As a result, air supplied from the air compressor 51 can be employed to increase the pressure inside the water reservoir 25 in order to make the size of the water droplets sprayed from the spray nozzle 21 small. Further, since the air can be supplied to the spray nozzle 21 via the second pipeline 54, it is possible to adjust the spray condition of the water sprayed from the spray nozzle 21 to obtain the desired white smoke W. Moreover, the cryogenic liquefied gas emission nozzle 17 and the spray nozzle 21 are placed inside the apparatus main body 11 of this white smoke generating apparatus 50, while the cryogenic liquefied gas supply mechanism 12 and the humidifying and heating mechanism 53 are provided outside the apparatus. Thus, the apparatus can be simplified, facilitating its manufacture.

Next, the results obtained in experiments performed to confirm the effects of the white smoke generating apparatus of the present invention will be explained.

In these experiments, a white smoke generating apparatus identical to the white smoke generating apparatus 40 shown in FIG. 2 was employed, while a vinyl chloride T joint 200 mm in diameter was employed as a duct joint 42, and a fan was employed as an air supply mechanism 14. Further, liquid nitrogen was used as a cryogenic liquefied gas 15.

The experiments were carried out under the conditions described below, with visual observations made of the white smoke W generated.

Experiment 1

The white smoke generating apparatus 40 was placed in a 25° C., 70% humidity atmosphere. Liquid nitrogen from the cryogenic liquefied gas reservoir 16 was introduced into the second pipeline 24 via the first pipeline 18 at a pressure of 5 kg/cm$^2$ (gauge pressure). The liquid nitrogen was then vaporized by the cryogenic liquefied gas vaporizer 22, and the gas (20° C.) was supplied to the spray nozzle 21 via the second pipeline 24, and to the water reservoir 25 via the third pipeline 28. As the gas was sent into the water reservoir 25, the pressure inside increased, supplying water 25*a* to the spray nozzle 21 via the third pipeline 28. Water 25*a* and gas from the spray nozzle 21 were then sprayed inside the apparatus main body 11, humidifying the air E inside the apparatus main body 11. The amount of humidification was a saturated moisture level at 30° C. Air E was supplied to the apparatus main body 11 at a rate of 360 m$^3$/hr by a fan provided to the air intake opening 11*b*.

The first solenoid valve 20 was opened, introducing liquid nitrogen into the first pipeline 18 from the cryogenic liquefied gas reservoir 16 at a pressure of 5 kg/cm$^2$ (gauge pressure). After passing through the first pipeline 18, the gas was then supplied to the cryogenic liquefied gas emission nozzle 17. Liquid nitrogen was then emitted from the cryogenic liquefied gas emission nozzle 17 into the apparatus main body 11, generating white smoke W as the liquid nitrogen came into contact with the humidified air E inside the apparatus main body 11. This white smoke W was then discharged from the white smoke discharge opening 11*a*. The amount of liquid nitrogen consumed in this example was 7.2 kg/min, while the amount of water 25*a* sprayed was from 1 to 200 ml/min.

The condition of the white smoke discharged from the white smoke discharge opening 11*a* as a result was excellent.

Experiment 2

The white smoke generating apparatus 40 was placed in a 20° C., 55% humidity atmosphere. The pressure of the liquid nitrogen introduced into the first pipeline 18 from the cryogenic liquefied gas reservoir 16 was 7 kg/cm$^2$ (gauge pressure), and the amount of liquid nitrogen consumed was 9.2 kg/min. With these exceptions, the white smoke W was generated in the same way as in Experiment 1, and was discharged from the white smoke discharge opening 11*a*.

The condition of the white smoke W discharged from the white smoke discharge opening 11*a* was excellent.

As is clear from the results of these experiments, this white smoke generating apparatus 40 and the method of using the same permits the generation of white smoke of a stable density which is not affected by the temperature or humidity conditions of the surrounding atmosphere.

What is claimed is:

1. A white smoke generating apparatus comprising an apparatus main body being provided with a white smoke discharge opening, the apparatus main body containing an atmosphere therein;

a cryogenic liquefied gas supply mechanism for supplying a cryogenic liquefied gas into the apparatus main body; and a humidifying mechanism for humidifying the atmosphere inside the apparatus main body;

wherein the cryogenic liquefied gas supply mechanism is provided with a first pipeline which communicates a cryogenic liquefied gas reservoir and a cryogenic liquefied gas emission nozzle placed inside the apparatus main body; the humidifying mechanism comprises a second pipeline which branches from the first pipeline and communicates with a spray nozzle placed inside the apparatus main body for spraying water, and a third pipeline which branches from the second pipeline and communicates with the spray nozzle via a water reservoir; and a cryogenic liquefied gas vaporizer is provided inside the second pipeline upstream from the point where the third pipeline branches from the second pipeline.

2. A white smoke generating apparatus according to claim 1 wherein the humidifying mechanism is a humidifying and heating mechanism for humidifying and heating the atmosphere inside the apparatus main body.

3. A white smoke generating apparatus according to claim 1 wherein an air intake opening is provided to the apparatus main body.

4. A white smoke generating apparatus according to claim 3 wherein an air supply mechanism for sending air into the apparatus main body and a heating means for heating the air are provided to the air intake opening.

5. A white smoke generating apparatus according to claim 1 wherein two or more white smoke discharge openings are provided to the apparatus main body.

6. A white smoke generating apparatus comprising an apparatus main body being provided with a white smoke discharge opening, the apparatus main body containing an atmosphere therein;

a cryogenic liquefied gas supply mechanism for supplying a cryogenic liquefied gas into the apparatus main body; and a humidifying mechanism for humidifying the atmosphere inside the apparatus main body;

wherein the cryogenic liquefied gas supply mechanism is provided with a first pipeline which communicates a cryogenic liquefied gas reservoir and a cryogenic liquefied gas emission nozzle placed inside the apparatus main body; the humidifying mechanism is provided with a second pipeline which communicates an air compressor for supplying air and a spray nozzle placed inside the apparatus main body for spraying water, and a third pipeline which branches from the second pipeline and communicates with the spray nozzle via a water reservoir.

7. A white smoke generating apparatus according to claim 6 wherein the humidifying mechanism is a humidifying and heating mechanism for humidifying and heating the atmosphere inside the apparatus main body, the mechanism being provided with a fourth pipeline for directing a portion of the air from the air compressor into the apparatus main body via a heating means.

8. A white smoke generating apparatus according to claim 6 wherein an air intake opening is provided to the apparatus main body.

9. A white smoke generating apparatus according to claim 8 wherein an air supply mechanism for sending air into the apparatus main body and a heating means for heating the air are provided to the air intake opening.

10. A white smoke generating apparatus according to claim 6 wherein two or more white smoke discharge openings are provided to the apparatus main body.

11. A white smoke generating method comprising the steps of spraying water by sending gas along with a supply of water to a spray nozzle placed inside an apparatus main body being provided with a white smoke discharge opening so as to create a humid atmosphere inside the apparatus main body;

generating white smoke by emitting cryogenic liquefied gas into the humid atmosphere inside the apparatus main body; and discharging the white smoke through the white smoke discharge opening.

12. A white smoke generating method according to claim 11 further comprising the step of supplying air into the apparatus main body.

13. A white smoke generating method according to claim 12 further comprising the step of heating the air when the air is supplied into the apparatus main body, while the amount of the air supplied is regulated.

* * * * *